US007034773B1

(12) United States Patent
Saunders et al.

(10) Patent No.: US 7,034,773 B1
(45) Date of Patent: Apr. 25, 2006

(54) ADAPTIVE MULTIFILAR ANTENNA

(75) Inventors: Simon Reza Saunders, Ash (GB); Andreas-Albertos Agius, Patras (GR)

(73) Assignee: University of Surrey, Surrey (GB)

( * ) Notice: Subject to any disclaimer, the term of this patent is extended or adjusted under 35 U.S.C. 154(b) by 0 days.

(21) Appl. No.: 09/622,382

(22) PCT Filed: Feb. 15, 1999

(86) PCT No.: PCT/GB99/00469

§ 371 (c)(1),
(2), (4) Date: Jan. 12, 2001

(87) PCT Pub. No.: WO99/41803

PCT Pub. Date: Aug. 19, 1999

(30) Foreign Application Priority Data

Feb. 16, 1998 (GB) ..... 9803273

(51) Int. Cl.
*H01Q 1/36* (2006.01)

(52) U.S. Cl. ..... 343/895; 343/750

(58) Field of Classification Search ..... 343/895, 343/750, 745, 861, 868

See application file for complete search history.

(56) References Cited

U.S. PATENT DOCUMENTS 5,828,348 A * 10/1998 Tassoudji et al. ..... 343/895

* cited by examiner

*Primary Examiner*—James Vannucci
(74) *Attorney, Agent, or Firm*—Leydig, Voit & Mayer, Ltd

(57) ABSTRACT

A multifilar antenna (200) comprises n spaced antenna filaments, where n is on integer greater than 1; a matching circuit (210) for matching the characteristic impedance of the antenna to that of a transmitting and/or receiving apparatus; a weighting circuit (240) for applying respective gain and phase adjustments to signals passed to or from the n filaments; switch means (310) associated with each filament for selectively altering the electrical length and/or interconnections of the filaments; means for detecting electrical properties of the multifilar antenna with respect to the frequency, polarisation and/or direction of propagation of a signal to be received or transmitted by the multifilar antenna and/or impedance matching of the antenna; and control means (230), responsive to the detective means, for controlling the operation of the matching circuit (210), the weighting circuit (240) and the switch means (310) to adjust the properties of the multifilar antenna (200) to suit better a current signal to be received or transmitted.

22 Claims, 4 Drawing Sheets

ADAPTIVE MULTIFILAR ANTENNA

This invention relates to adaptive multifilar antennas.

In fields such as mobile telephony and communication, it is being proposed that radio frequency transceivers operating in different frequency bands, and providing different services, should be integrated into single consumer devices.

For example, in order to improve the coverage area in which a mobile telephone can be used, a satellite system transceiver, a terrestrial transceiver and a domestic cordless telephone transceiver might be integrated into one hand-held unit. An alternative example is a dual service telephone operating at 1800MHz in the user's home country but having the capability of operating at 900MHz in other countries under a so-called roaming arrangement.

The electronics needed to achieve this aim are rapidly becoming smaller and lighter. A remaining problem area for multi-frequency, multi-system operation, however, is the antenna.

In order to operate as described above, an antenna should be able to work at different frequencies and with different types of base station. For example, one service may use terrestrial base stations and another may use orbiting satellites. This means that if the handset antenna is typically used in a vertical position (with the handset held next to the user's head) then for one service the antenna should have a radiation pattern substantially omnidirectional in azimuth and for the other service is should have an approximately hemispherical radiation pattern.

To cater for the different pattern and frequencies in use, it has been proposed to employ at least two distinct antennas within a common value.

In a first aspect, the invention provides an adaptive multifilar antenna comprising:

n spaced filaments, where n is an integer greater than 1;

a matching circuit for matching the characteristic impedance of the antenna to that of a transmitting and/or receiving apparatus;

a weighting circuit operable to apply respective phase adjustments to signals passed to and/or from the n filaments;

detecting means operable to detect at least one electrical property of the multifilar antenna with respect to the frequency, polarisation and/or direction of propagation of a signal to be received or transmitted by the multifilar antenna and/or impedance matching of the antenna; and control means, responsive to the detecting means, operable to control the operation of the weighting circuit to adjust the properties of the multifilar antenna to suit better a current signal to be received or transmitted.

In another aspect, this invention also provides a multifilar antenna comprising:

n spaced antenna filaments, where n is an integer greater than 1;

a matching circuit for matching the characteristic impedance of the antenna to that of a transmitting and/or receiving apparatus;

a phasing circuit for applying respective gain and phase adjustments to signals passed to or from the n filaments;

switch means associated with each filament for selectively altering the electrical length and/or interconnections of the filaments;

means for detecting electrical properties of the multifilar antenna with respect to the frequency, polarisation and/or direction of propagation of a signal to be received or transmitted by the multifilar antenna and/or impedance matching of the antenna; and control means, respective to the detecting means, for controlling the operation of the matching circuit, the phasing circuit and the switch means to adjust the properties of the multifilar antenna to suit better a current signal to be received or transmitted.

In the invention, the phase and/or gain relationships for signals from individual filaments of a multifilar antenna, along with the electrical length and interconnection pattern of the filaments, can be varied automatically in order (or possibly to optimise, within the resolution of the adjustment system) the properties of the antenna for a particular signal to be received or transmitted.

For example, in embodiments of the invention, at least one of the above parameters could be varied to provide the best received signal level, the best signal to noise ratio, or the best signal to (noise plus interference) ratio and/or the best VSWR.

The adjustments will generally lead to a change in the antenna's frequency response and radiation pattern (shape and polarisation). It may not matter to the adjustment system what that change is quantitatively; the system may simply measure the output and make adjustments so as to improve the handling of the current signal.

The invention will now be described by way of example with reference to the accompanying drawings, throughout which like parts are referred to by like references, and in which:

FIG. 1 is a schematic diagram of a quadrifilar helical antenna (QHA).

The QHA comprises four helical elements 10..40 and eight radial elements 50..120. (In other embodiments six, for example, angularly spaced helical elements could be used).

Figure 1:
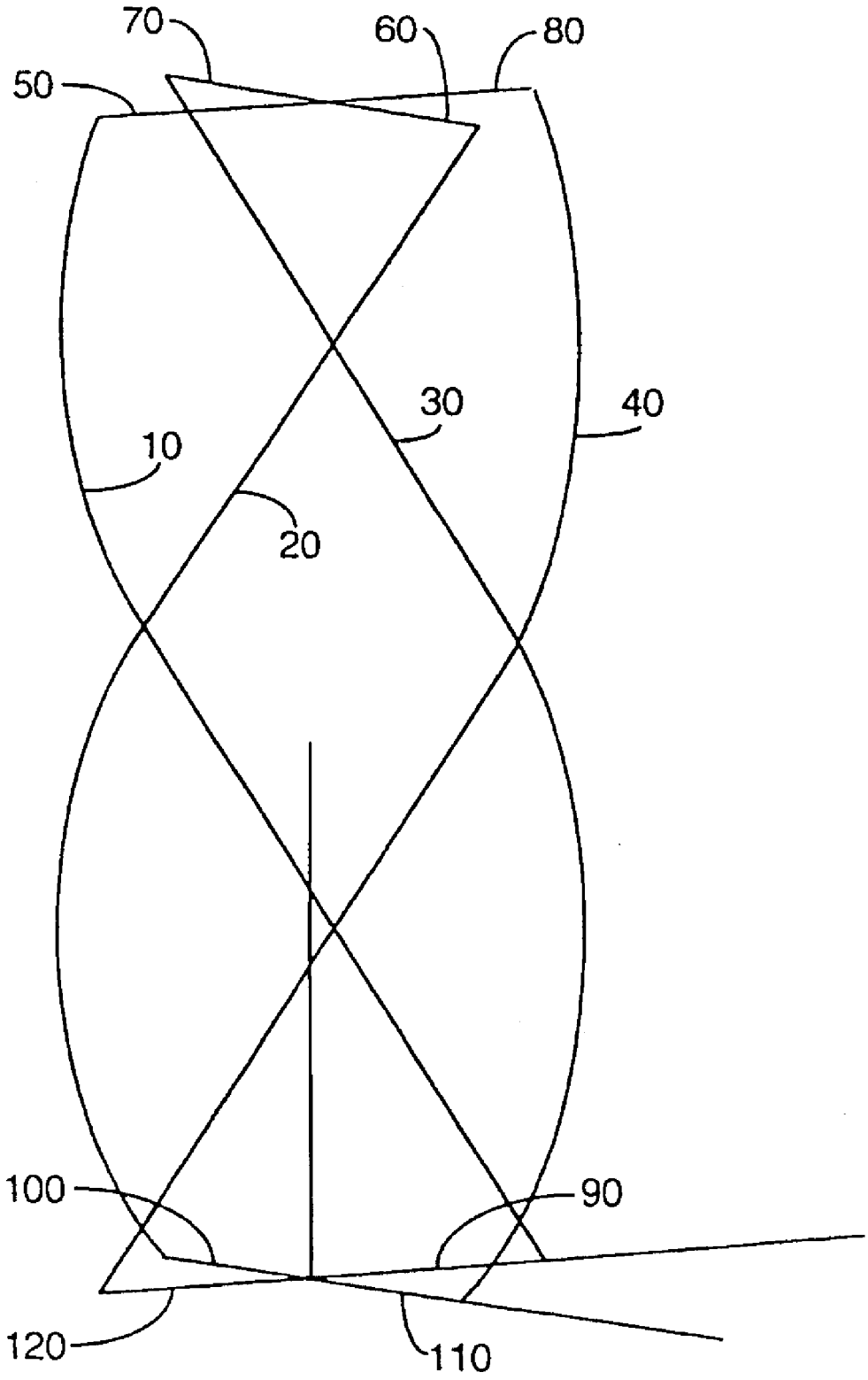
FIG. 1 is a schematic diagram of a quadrifilar antenna.

The helical elements are intertwined as shown in FIG. 1, and are disposed about a longitudinal axis of the antenna by 90° with respect to one another. Four of the radials 50..80 are disposed on the top and four 90..120 on the bottom of the volute, connecting the helical elements and forming two bifilar loops. The antenna is fed on one set of radials 90, 110 with 90° phase difference between the two feeds.

The radials 50..80 at the top end of the antenna with respect to the feed (which in this example are at the bottom) may be shorted in pairs of may be open-circuit depending on the resonant length of the helical elements and the required response.

The QHA is described in the following references:

[1] Kilgus C. C., "Multielement, Fractional Turn Helices", IEEEE transactions on Antenna and Propagation, Vol. AP-16, pp. 499–500, July 1968

[2] Kilgus C. C., "Resonant Quadrifilar Helix", IEEE Transactions on Antenna and Propagation, Vol. AP-17, pp. 349–351, May 1969

[3] Kilgus C. c., "Resonant Quadrifilar Helix Design", The Microwave Journal, December 1970.

The antenna's radiation pattern mode (hemispherical or other) depends on the phase combination used on the two or four feeds. The exact shape of the antenna's radiation pattern in each mode depends on the pitch and dimensions of the helicies. In the axial mode it has a shape varying from hemispherical to cardioid depending on the dimensions of the structure. The polarisation is circular with a very good axial ratio inside the 3 dB angle.

In other embodiments, the multifilar antenna arrangement can also be used for diversity purposes. The different filaments can be used to provide space diversity between generally uncorrelated received signals. The effect of weighting the gain and/or phase can affect both the shape and the polarisation of the radiation pattern. This effect can benefit the transceiver in two ways. Firstly, the pattern shape and the polarisation are matching the direction and the polarisation of the incoming signal to try to optimise or improve the criterion ratio (S/N or S/(N+1), and secondly the structure can be used for polarisation diversity using the resulting pattern of different filaments or pairs of filaments.

FIG. 1 shows an antenna which has a generally cylindrical volute (i.e. circular in plan). Other volute shapes such as those having elliptical or rectangular plans are also suitable for use in the present invention.

Figure 2:
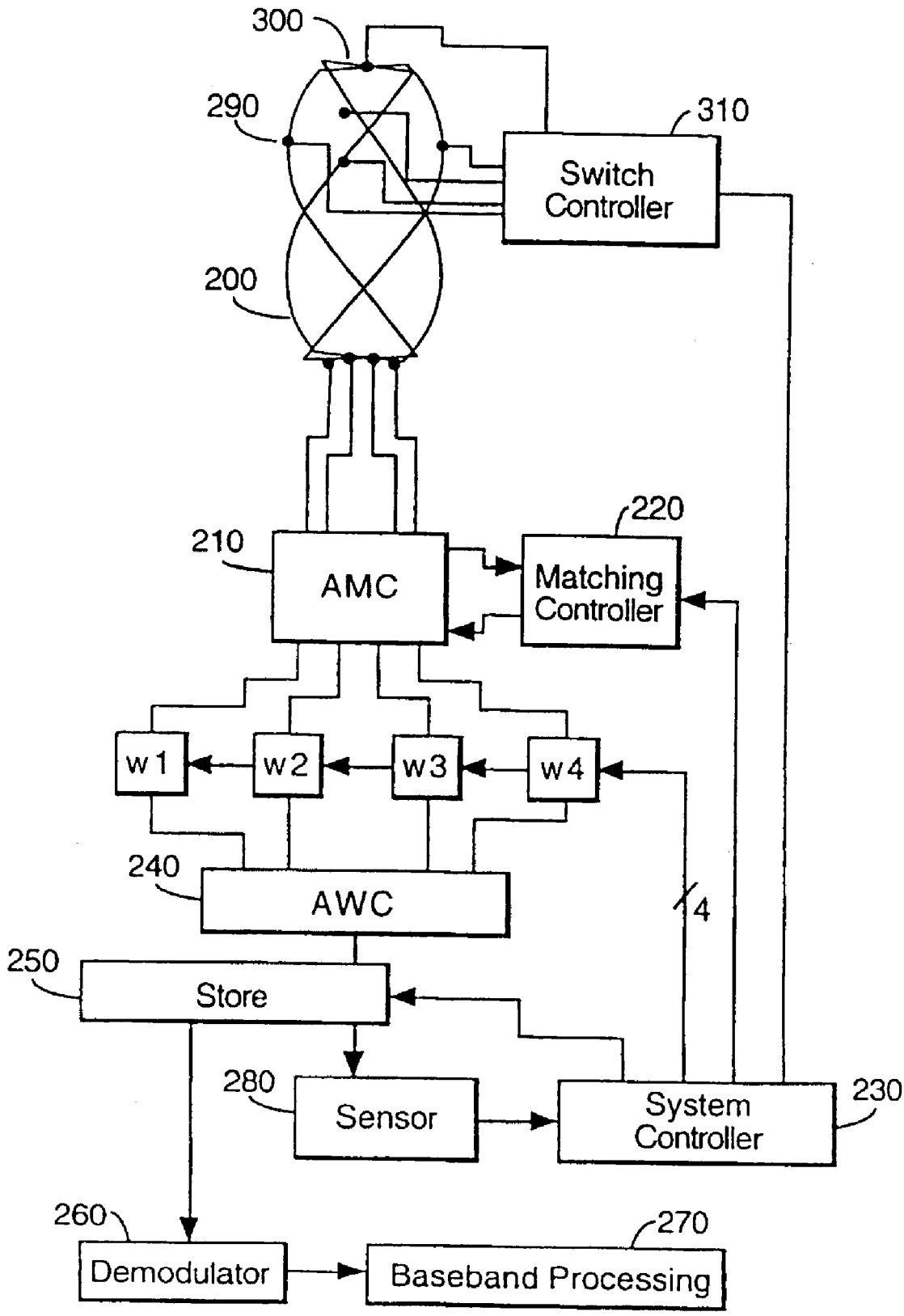
FIG. 2 is a schematic diagram of an antenna interface circuit.

FIG. 2 is a schematic diagram of an antenna system comprising an adapted QHA 200 and an antenna interface circuit.

In FIG. 2, the four elements of the QHA 200 are connected separately to an adaptive matching circuit 210. (In the configuration shown in FIG. 2, the antenna is in a receive mode, but it will be clear that signals could instead be supplied to the antenna, in a transmit mode, by reversing the direction of signal propagation arrows in FIG. 2.) The adaptive matching circuit 210 is under the control of a matching controller 220, which in turn is respective to a system controller 230.

Received signals from the adaptive matching circuit are supplied to four respective variable weighting circuits W1..W4. Each of W1..W4 comprises a variable phase delay and optionally, a variable gain stage, all controllable by the system controller 230.

The outputs of the four variable weighting elements W1..W4 are combined by an adder/weight combiner 240 to form a composite signal. This composite signal is then stored 250. A sensor 280 examines the signal (e.g. the level of the signal to (noise plus interference) ratio) and passes this information to the controller which in turn adjusts the weighting factors of the weighting elements W1..W2, the matching circuit 210 and the switch elements 290,300 to improve or possibly optimise the parameter sensed by the sensor 280. The optimisation information can be used to optimise or improve the quality of the stored signal, which is then passed to the demodulator 260. The information is also used to adjust the antenna system to receive the next incoming signal.

In each element of the QHA, there is a switch 290 capable of isolating a portion of the element remote from the feed point. The switch could be, for example, a PIN diode switch. Similarly, a switch 300 is capable of shorting or isolating pairs of the elements at the end remote from the feed point.

The operations performed by the switches 290 and 300, under the control of a switch controller 310, can change the response and radiation pattern of the antenna. In particular, by isolating a section of each element, the electrical length of the elements is made shorter and so the frequency of operation will be higher. Again, these operations are carried out under the control of the system controller to improve or possibly optimise operation with a particular signal frequency, polarisation and direction of propagation.

Alternatively, or additionally, the antenna element may be caused to have several resonant modes by the inclusion of one or more antenna traps. This causes the antenna to be resonant (and therefore have increased gain) at more than one operating frequency.

Figure 3:
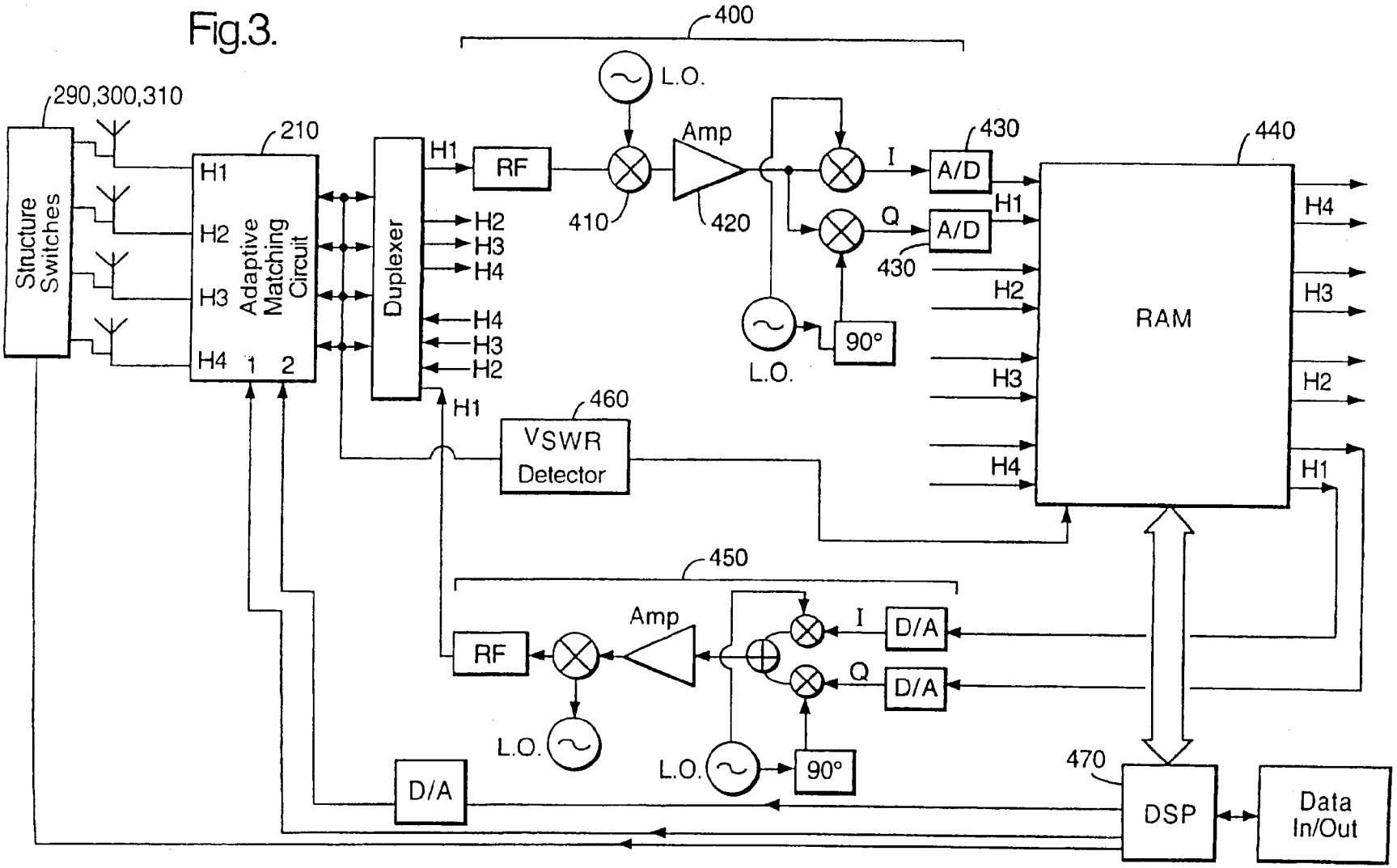
FIG. 3 is a more detailed schematic diagram of one possible implementation of the antenna system of FIG. 2.

FIG. 3 is a more detailed schematic diagram of one possible implementation of the antenna system of FIG. 2, which also shows operation to improve or optimise the VSWR during a transmission operation and S/N+I during a receive mode. (Incidentally, when S/N+I is improved by adapting the antenna matching in a receive mode, this has an indirect side-effect of tending to improve the VSWR. Also, when the pattern mode, polarisation and direction are improved by adjusting for the best or an improved S/N+I, this similarly has a corresponding improving effect in a transmit mode.)

In FIG. 3, the operation of the weighting elements W1..W4 is carried out at baseband in a digital domain, as is the operation of the adder/weight combiner 240.

The output of the adaptive matching circuit 210 is supplied to a quadrature downconverter 400 comprising an intermediate stage 410 where a local oscillator signal is mixed with the radio frequency signal, an amplifier 420 and a further stage of mixing with a local oscillator signal with a 0° and 90° phase relationship to generate two demodulated outputs I and Q. These are both converted to digital representations by A/D converts 430 before being stored in a RAM 440. This process is replicated for each of the filaments of the QHA. Similarly, for the transmit side, an output from the RAM 440 is passed to a quadrature modulator 450 before being routed via the adaptive matching circuit 210 to the respective antenna filaments. A VSWR detector 460 operates in a transmit and/or receive mode to detect the standing wave ratio of the antennas. The output of this is stored in the RAM 440.

The RAM is connected to a digital signal processing (DSP) unit 470 which combines the digital representations of the signals stored in the RAM 440 in respective proportions and using respective phases (i.e. performs the operation of the weighting blocks W1..W4), detects and optimises the selected parameter such as signal-to-noise ratio, sends control signals to the adaptive matching circuits to change from one frequency band to another or to overcome de-tuning effects, and also controls the switch controller 310 and in turn the switches 290,300 within the helical elements.

One appropriate DSP algorithm is for the transmitter to send packet header, reference or training symbols, which are known to the receiver. Any disturbance to the received signals during the reception of the training symbols is a measure of N+I and can be reduced by trial and error (repeated combining of the digital representations stored in the RAM 440), direct matrix inversion of the associated correlation matrix or by iteration approaches such as so-called LMS or RLS algorithms. However, even if known training symbols are not available, a measure of the disturbance to the signal can be made by error detection algorithms applied to the received symbols.

Figure 4:
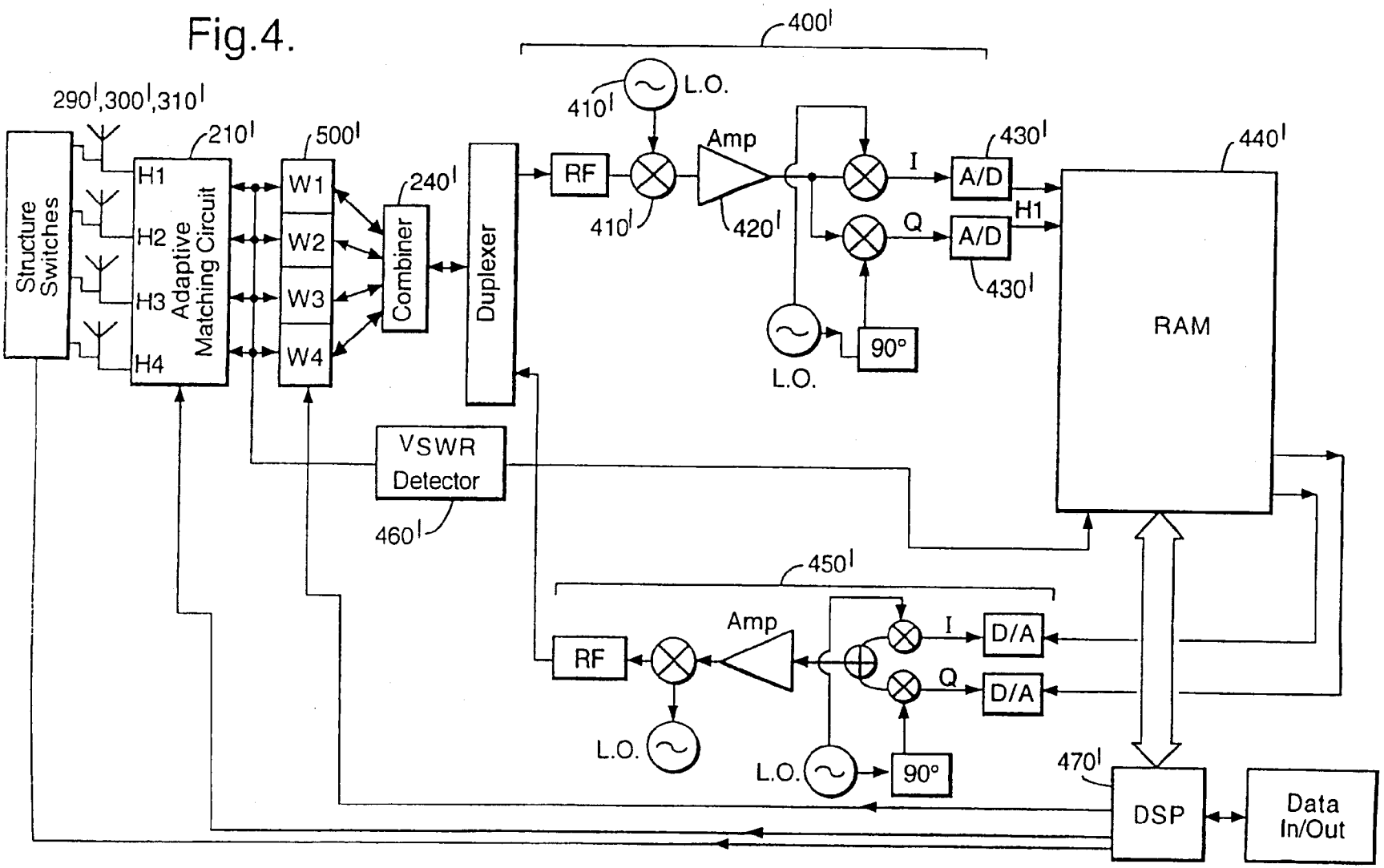
FIG. 4 is a more detailed schematic diagram of another possible implementation of the antenna system of FIG. 2.

FIG. 4 is a more detailed schematic diagram of an alternative implementation of the antenna system of FIG. 2. This implementation has a quadrature downconverter 400' which operates in the same way as the downconverter 400 of FIG. 3. Similarly, it has a quadrature modulator 450' which operates in the same way as the modulator 450 of FIG. 3.

The operation at baseband of the implementation shown in FIG. 4 is also similar to that of FIG. 3 in that the downconverted signals are converted into the digital domain and stored in a RAM 440'. The data in the RAM is processed by a digital signal processing unit 470' and the DSP 470' is operable to cause changes in the adaptive matching circuit 210' and in the antenna switches 290',300' and 310'.

However, the operation of a circuit of FIG. 4 differs significantly from that of FIG. 3 in that the weighting operation is performed at RF in weighting blocks 500 which are coupled in the signal path from the individual antenna elements to the quadrature downconverter 400'.

In FIG. 4, the weighting block 500 is coupled directly between the adaptive matching circuit 210' and a combiner 240' which operates to additively combine the outputs of the respective weighting W1, W2, W3, W4 contained in the weighting block 500.

The output of the combiner 240' is fed into a single quadrature downconverter 400'. Thus, unlike the implementation shown in FIG. 3, only one downconverter 400' is required. Similarly, only one quadrature modulator 450' is required.

This alternative implementation has two main advantages. Firstly, since only one downconverter 400' and one modulator 450' is required, there is a resultant cost saving in the manufacture of the transceiver.

Secondly, since most of the noise in the received signal is introduced by the receiver, there is a fourfold decrease in the noise added by the receiver section since the signal passes through only one (instead of four) downconverters 400'. As a further subsidiary advantage, since the signal from all four antenna elements is subjected to the same noise in the single downconverter 400', it is not necessary to apply gain weightings. Thus the weighting circuits W1, W2, W3, W4 may be arranged only to apply phase adjustments to the signals received by the antenna elements. This simplifies their construction and therefore also has cost and reliability advantages.

In order to optimise the weightings, a slightly different approach may be taken to that used with the implementation of FIG. 3. It will be noted that in the implementation of FIG. 3, the stored data may be iteratively processed with different weightings applied to the data until an optimal or at least improved result is obtained. However, in the implementation of FIG. 4, the data stored in the RAM 440' already has weightings applied to it and in fact the signals from each of the elements of the antenna have already been combined by the combiner 240'. Thus, in order to find the correct weightings, the weightings are adjusted dynamically during reception of a signal (for example a training sequence). by storing data representing the known weighting settings against data representing the quality of the received signal, it is possible to determine which weighting gives the best reception and/or transmission characteristics. Thus the principles are similar but in the first case (FIG. 3) the weighting optimisation may occur "off line" whereas in the implementation of FIG. 4, the weighting optimisation occurs "on line" during reception of a signal.

What is claimed is:

1. An adaptive multifilar antenna comprising:

a number of spaced filaments, where said number is an integer greater than 1;

a matching circuit for matching the characteristic impedance of the antenna to that of a transmitting and/or receiving apparatus;

a weighting circuit operable to apply respective phase adjustments to signals passed to and/or from the spaced filaments;

detecting means operable to detect at least one electrical property of the multifilar antenna with respect to the frequency, polarisation and/or direction of propagation of a signal to be received or transmitted by the multifilar antenna and/or impedance matching of the antenna; and control means, responsive to the detecting means, operable to control the operation of the weighting circuit to adjust the properties of the multifilar antenna to suit better a current signal to be received or transmitted.

2. An antenna according to claim 1, wherein the weighting circuit is operable to apply gain adjustments to signals passed to and/or from the spaced filaments.

3. An antenna according to claim 1, wherein the control means is operable to control the operation of the matching circuit to adjust the properties of the multifilar antenna to suit better a current signal to be received or transmitted.

4. An according to claim 1, including switching means associated with each filament for selectively altering the electrical length and/or interconnections of the filaments and the signal connections to/from the filaments being at a first end of each filament; and the switch means being operable to selectively interconnect pairs of filaments at a second end of those filaments remote from the first end.

5. An antenna according to claim 1, including switch means associated with each filament for selectively altering the electrical length and/or interconnections of the filaments and each filament including at least a first filament section and a second filament section; and the switch means being operable to selectively connect or isolate the first and second filament sections of each filament so as to vary the electrical length of that filament.

6. An antenna according to claim 1, in which:

the detecting means is operable to detect a signal to noise ratio of a received signal; and the control means is operable to control the operation of the matching circuit and/or the weighting circuit so as to improve the signal to noise ratio of the received signal.

7. An antenna according to claim 1, in which:

the detecting means is operable to detect a signal to noise plus interference ratio of a received signal; and the control means is operable to control the operation of the matching circuit and/or the weighting circuit so as to improve the signal to noise plus interference ratio of the received signal.

8. An antenna according to claim 1, in which:

the detecting means is operable to detect a signal level of a received signal; and the control means is operable to control the operation of the matching circuit and/or the weighting circuit so as to improve the signal level of the received signal.

9. An antenna according to claim 1, in which:

the detecting means is operable to detect a VSWR for a transmitted signal; and the control means is operable to control the operation of the matching circuit and/or the weighting circuit so as to improve the VSWR for transmission of that signal.

10. An antenna according to claim 1, in which the detecting means comprises:

analogue to digital conversion means for converting respective signals received by the filaments into corresponding digital representations a memory for storing the digital representations;

means for combining the digital representations using respective phase relationships and gains; and means for detecting properties of the antenna by analysis of the combined digital representations.

11. An antenna according to claim 1, in which the detecting means comprises:

means for combining respective signals received by the filaments using respective phase relationships analogue to digital conversion means for converting the combined signals into a corresponding digital representation;

a memory for storing the digital representation; and means for detecting properties of the antenna by analysis of the combined digital representations.

12. An antenna according to claim 11, wherein the combining means is operable to combine the respective signals using respective gain weightings.

13. An antenna according to claim 1, in which the detecting means operates at least during reception of a reference signal burst by the antenna.

14. An antenna according to claim 1, in which said number is an even integer.

15. An antenna according to claim 1, in which said number is equal to 4 to 6.

16. An antenna according to claim 1, in which the filaments are helically shaped.

17. An antenna according to claim 1, in which the filaments are at least partially intertwined.

18. An antenna according to claim 1, having a volute of generally elliptical or rectangular axial cross-section.

19. An antenna according to claim 1, wherein the weighting circuit operates at baseband.

20. An antenna according to claim 1, wherein the weighting circuit operates at RF.

21. An Antenna according to claim 20, wherein the respective outputs of the weighing circuit are combined prior to frequency downconversion.

22. An adaptive multifilar antenna comprising:

a number of spaced antenna filaments, where said number is an integer greater than 1;

a matching circuit for matching the characteristic impedance of the antenna to that of a transmitting and/or receiving apparatus;

a phasing circuit for applying respective gain and phase adjustments to signals passed to or from the spaced filaments;

switch means associated with said filament for selectively altering the electrical length and/or interconnections of the filaments;

means for detecting electrical properties of the multifilar antenna with respect to the frequency, polarisation and/or direction of propagation of a signal to be received or transmitted by the multifilar antenna and/or impedance matching of the antenna; and control means, responsive to the detecting means, for controlling the operation of the matching circuit, the phasing circuit and the switch means to adjust the properties of the multifilar antenna to suit better a current signal to be received or transmitted.

* * * * *